US005398783A

United States Patent [19]

Jacoby

[11] Patent Number: 5,398,783

[45] Date of Patent: Mar. 21, 1995

[54] ELEVATOR HALL CALL DEVICE WITH INTEGRAL INDICATOR DISPLAY ELEMENT

[75] Inventor: Herbert Jacoby, Farmington, Conn.

[73] Assignee: Otis Elevator Company, Farmington, Conn.

[21] Appl. No.: 12,558

[22] Filed: Feb. 2, 1993

[51] Int. Cl.[6] ..... B66B 1/14

[52] U.S. Cl. ..... 187/395; 187/399; 200/56 R; 200/314

[58] Field of Search ..... 187/121, 130, 133, 135, 187/137, 139, 122, 127; 200/312, 314, 56 R; 340/712, 762

[56] References Cited

U.S. PATENT DOCUMENTS

| | | | |
|---|---|---|---|
| 4,043,429 | 8/1977 | Hirasawa et al. | 187/29 R |
| 4,102,437 | 7/1978 | Mandel | 187/121 |
| 4,716,992 | 1/1988 | Kunii | 187/121 |
| 4,724,933 | 2/1988 | Tsuji et al. | 187/137 |
| 4,805,739 | 2/1989 | Lind et al. | 187/121 |
| 4,832,157 | 5/1989 | Kitano | 187/1 R |
| 4,852,696 | 8/1989 | Kukuda et al. | 187/139 |
| 4,915,197 | 4/1990 | Schroder | 187/121 |
| 4,956,528 | 9/1990 | Janniare et al. | 200/314 |
| 5,045,656 | 9/1991 | Kojima et al. | 200/314 |
| 5,072,085 | 12/1991 | Shinohara et al. | 200/314 |
| 5,179,369 | 1/1993 | Person et al. | 340/712 |
| 5,194,702 | 3/1993 | Swonger et al. | 187/139 |

FOREIGN PATENT DOCUMENTS

| | | | |
|---|---|---|---|
| 9102425 | 6/1991 | Germany . | |
| 1-252474 | 10/1989 | Japan | 187/130 |
| 1-288584 | 11/1989 | Japan | 187/130 |
| 2-86578 | 3/1990 | Japan | 187/121 |
| 3-8677 | 1/1991 | Japan | B66B 3/00 |
| 3-147685 | 6/1991 | Japan | 187/124 |
| 4-333479 | 11/1992 | Japan | 187/135 |

OTHER PUBLICATIONS

Cherry product brochure, Switches by Cherry, The Cherry Corporation, Waukegan, Ill.

*Primary Examiner*—Steven L. Stephan
*Assistant Examiner*—Robert Nappi

[57] ABSTRACT

An elevator hall call button includes a switch (20, 56) as well as displays (21, 54, 55) comprising matrices of light emitting diodes to provide an indication to a passenger of the imminence of arrival of the responding car. The display can be floor position (FIG. 5), flashing at a varying speed (FIG. 6) flashing at a lobby floor whenever a car approaches the lobby (FIG. 7) or in response to a lobby call (FIG. 8), an arbitrary number which reduces in response to the car approaching (FIGS. 9 and 10), or time remaining (FIG. 11).

17 Claims, 4 Drawing Sheets fig.4
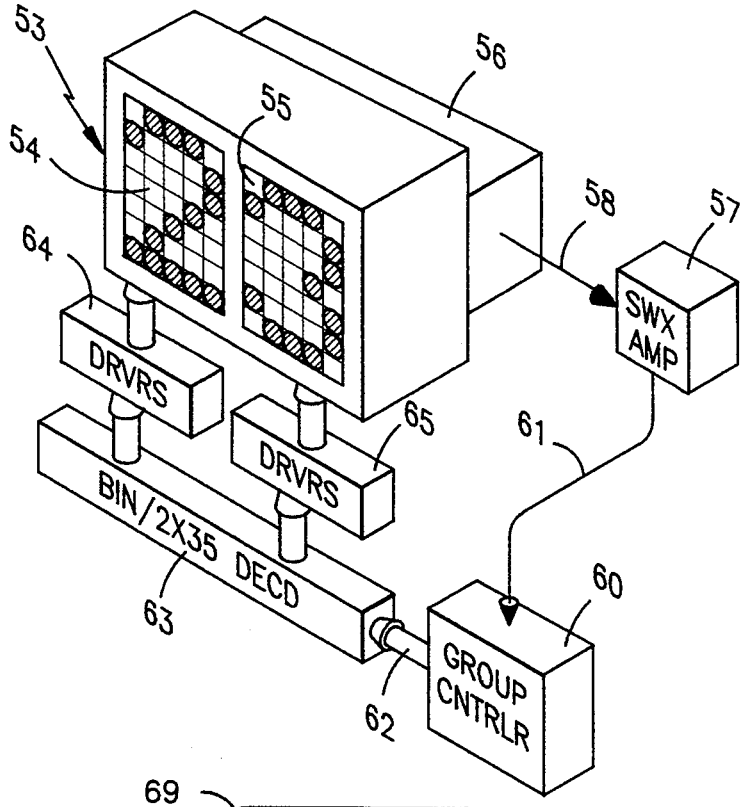
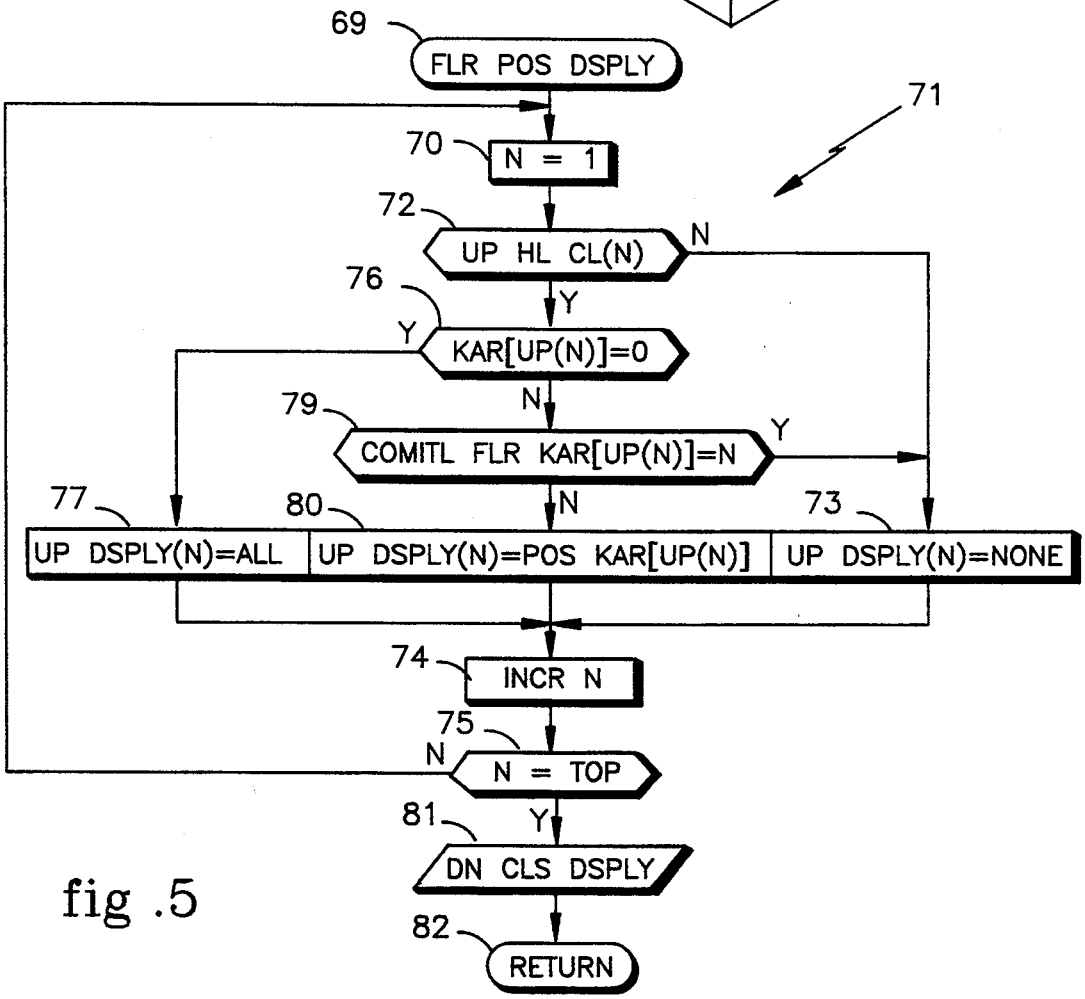
fig .5

ELEVATOR HALL CALL DEVICE WITH INTEGRAL INDICATOR DISPLAY ELEMENT

TECHNICAL FIELD

This invention relates to elevator call buttons that also provide an indication of response to the call.

BACKGROUND ART

Early elevator systems typically had indicators, at least on the lobby floor, of the floor position of the individual elevator. Later, elevator floor position in larger systems was typically provided only on a supervisory panel, where all the positions of all elevators were displayed side-by-side. Passengers were informed by "next car up" lights over the individual elevators of a group.

In the larger elevator systems where there may be three or more elevators serving a particular lobby landing, there is typically no warning that an elevator is about to arrive, and passengers must remain alert to the illumination of a floor lantern associated with a given elevator, and possibly the sounding of a relatively faint chime. In fact, it is common for passengers to press the hall call button and watch for it to be turned off as a clear idea that some elevator is coming, and thus they should look for a particular lantern to be lit.

Single elevator systems, typically hydraulic elevators, serving only a few floors, still typically provide an indication of the current elevator floor position. The purpose of this is more to advise potential passengers whether it's worth waiting for the elevator, or whether the passengers should alternatively use the stairs. In the smaller elevator systems, floor indicators, typically one light per floor over the elevator door or a mechanical indicator rotated in response to a cable connected with the position of the elevator car, can amount to a considerable portion of the expense for such a system. In order to make single elevator systems less expensive, the alternative has heretofore been to provide no indication of floor position, whatsoever.

DISCLOSURE OF INVENTION

Objects of the invention include provision of hall call button and indication of elevator response to hall calls.

According to the present invention, a hall call button switch includes a matrix of LEDs for providing an illuminated response, either position or relative time before arrival, in large elevator systems, as well as position at all times other than immediately following the making of a hall call request, in single car elevator systems.

According to the invention, an elevator hall call button has a plurality of light-emitting diodes (LEDs) arranged in a matrix so that selective activation thereof will portray information indicative of relative delay before an elevator will arrive. In one embodiment, the display is elevator floor position. According to another embodiment of the invention, an elevator hall call button has a plurality of LEDs that are illuminated at a flashing rate which becomes more rapid as a responding elevator approaches the floor. Another embodiment displays a number which approaches zero as the elevator approaches.

According to the invention, an elevator hall call button provides a visual indication of a parameter related to the possible delay of an elevator before it will arrive to answer the call. According further to the invention, the parameter relates to the distance of the assigned elevator to the floor where the call was made. In still further accord with the invention, the indication is a combination of flashing or flashing and steady illumination, in which the rate of flashing is an indication of the remaining delay, such as a slow rate of flashing indicating several floors and the rate increasing to a more rapid rate when only one or two floors remain.

According further to the invention, the indication of possible delay before the arrival of an elevator car to answer a hall call is provided by displaying a character which may for instance be the floor number of the current position of the assigned elevator car. In accordance further with the invention, the parameter may be actual or relative estimated time before arrival of the assigned elevator car. In still further accord with the invention, LEDs arranged in matrices may be utilized to provide one or two characters indicative of the delay before arrival of the assigned elevator car to answer the call.

In all of the foregoing, the indication may include an instantaneous steady response or a full matrix response to indicate to the passenger that the hall call has been recognized; in further accord with the invention, the normal steady lighting of a hall call button may continue until a car is actually assigned to answer the call, following which the indications of the parameter of delay referred to hereinbefore are provided in addition to or in lieu of the aforementioned steady indication.

The invention is particularly well suited to provide a low-cost floor position indicator for single elevator installations. The invention is well suited to providing indications of remaining delay to passengers waiting for response to a hall call or for lobby service by a selected one of a plurality of elevators, particularly when such elevators do not provide floor position indicators on all of the floors being served.

The invention may be practiced in a wide variety of formats and with features selected to suit any implementation thereof, utilizing only apparatus and techniques which are known in the art, in the light of the teachings which follow hereinafter.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 4 is a schematic block diagram of an embodiment of the invention which may be used in a multi-elevator system;

FIG. 5 is a logic flow diagram of a routine which may be used in a typical elevator system to operate the embodiment of FIG. 3 utilizing floor position;

BEST MODE FOR CARRYING OUT THE INVENTION

Figure 1:
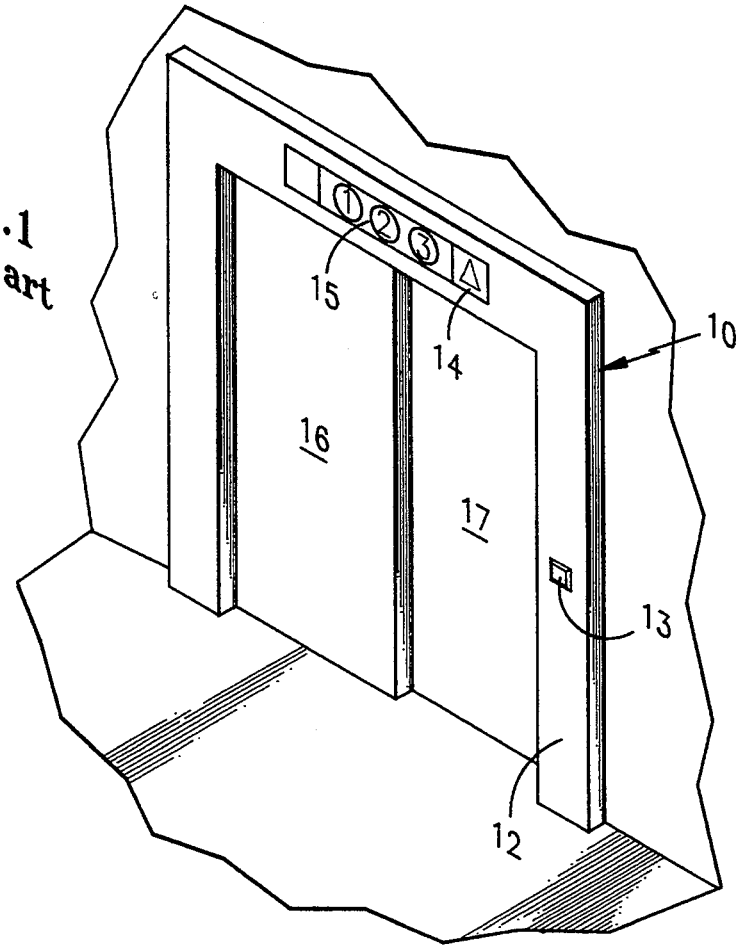
fig.1 prior art
FIG. 1 is a perspective view of the first floor landing of a single elevator system known to the prior art.

Referring now to FIG. 1, the facade 10 of a typical single elevator system such as may be used in buildings with only a few floors, includes a facia 12 in which are mounted a hall call button 13, a direction indicating hall lantern 14 and a set of floor position indicators 15. The elevator is shown with a pair of doors 16, 17 although elevators of this type may typically have but a single door. The facade 10 shown is typical for the lobby landing of a single elevator system (hence a single hall lantern 14 indicating up). On the upper floors of such a system, it is not usual to provide a set of floor position indicators 15. The uppermost floor would have a single hall lantern indicating the down direction, and any intermediate floor landing facades would have a pair of lanterns, one indicating the elevator traveling in the up direction and the other indicating the elevator traveling in the down direction. One embodiment of the invention combines the functions of the hall call button 13 and the set of floor position indicators 15, not only as a cost savings, but to make it easier for passengers to interact with the elevator.

Figure 2:
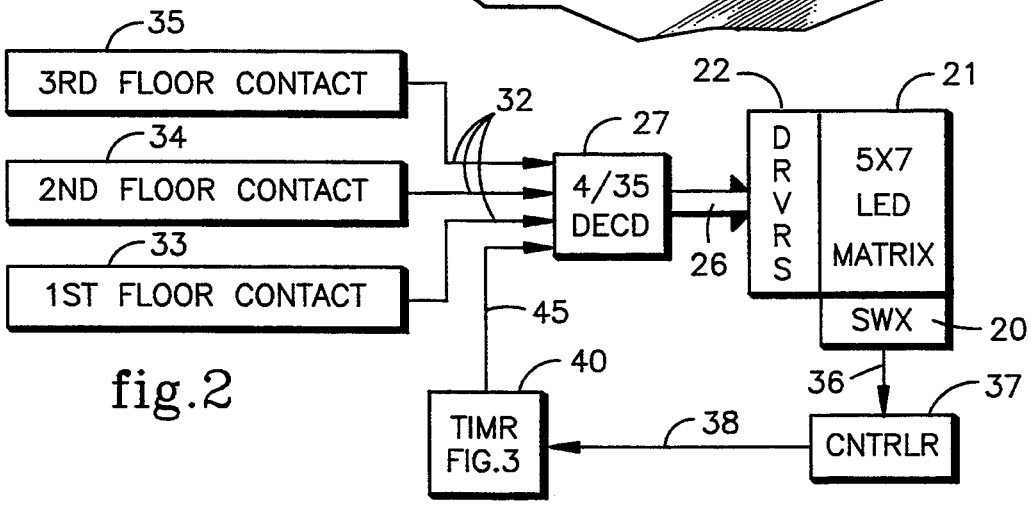
FIG. 2 is a schematic block diagram of a simple embodiment of the present invention which might be employed with a single elevator system.

In a first embodiment of the invention, the hall call button 13, known to the prior art, is exchanged for a hall call button switch display in accordance with the invention which includes not only a switch and LEDs to illuminate the button to indicate that a call has been made, but has those LEDs arranged in a matrix and operated selectively so as to provide more information to the passengers. In FIG. 2, the hall call button switch includes the switch 20 itself, which may either be a tactile switch or a motionless button as is well known in the art, along with a display 21 of LEDs arrayed in a matrix which may be five across and seven high in the usual way, or otherwise, along with the drivers 22 for illuminating the LEDs. The drivers 22 are operated by signals on lines 26 from a decode circuit 27 which converts any one of four inputs thereto into a correct set of LEDs so as to display the correct message to the passenger. When there is no passenger waiting for service, no registered hall call, the decode circuit 27 responds to a signal on one of a plurality of lines 32 from a corresponding floor contact 33–35, indicating the floor position of the elevator. This then will cause the display 21 to illuminate suitable LEDs to display the number 3, the number 2 (both of which are illustrated in FIG. 4) or the number 1, depending on the floor position of the elevator. Any floor position signals (as from an encoder, or otherwise) can be used. When, however, a passenger approaches and presses the switch 20 to request service to the floor, a signal on a line 36 to the car controller 37 will cause the controller 37 to register the call and provide a signal on a line 38 indicative thereof to a timer 40.

Figure 3:
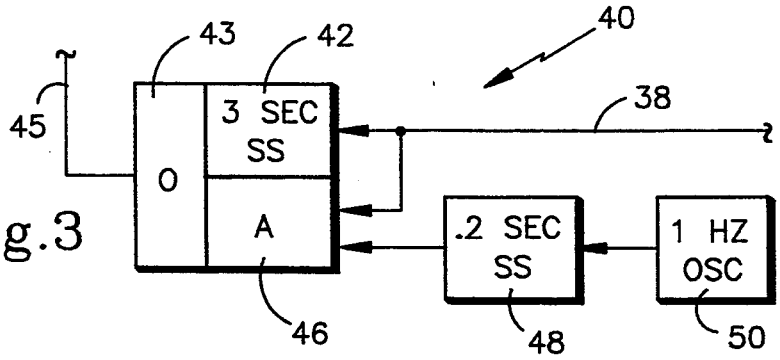
FIG. 3 is a schematic block diagram of a timer for use in FIG. 2.

In FIG. 3, the signal on the line 38 is fed to a three second single shot 42 which provides a signal through an OR circuit 43 on a line 45 to the input of the decode circuit 27. Any time a signal appears on the line 45, the decode circuit 27 illuminates all of the LEDs in the display 21, so as to cause the call button 13 to be fully illuminated in the same fashion as call buttons of the prior art (in which an incandescent lamp lights up the entire touch pad of the call button). The three second single shot 42 will cause the OR circuit 43 to present the signal on the line 45 for three seconds (of course some other time period can be chosen to suit any implementation of the present invention). This gives the passenger the normal assurance that his call has been recognized and will be responded to. Thereafter, the single shot 42 will no longer cause the OR circuit 43 to provide the signal. On the other hand, an AND gate 46 is enabled by the signal on the line 38 and it will periodically pass a signal from a two-tenths of a second single shot 48 through the OR circuit 43 to the line 45. The single shot 48 is enabled once per second by a one Hertz oscillator 50. Therefore, beyond three seconds after registering a hall call, the floor position of the elevator will again be displayed for eight-tenths of a second but will be interrupted for two-tenths of a second by a solid display of all the LEDs. This gives the passenger both the position of the car and the reassurance that his call will be answered. Of course, to suit any particular implementation, instead of illuminating all the LEDs every now and then while the passenger is waiting for the call to be answered, all of the LEDs could be shut off for a short period of time every now and then so that the floor number flashes, giving the passenger an indication that his call is being responded to. Thus, a non-informational (or alternative) illumination condition can be all (or nearly all) LEDs on, all LEDs off, or whatever. Of course, the timing can be selected to suit any use of the invention.

The physical structure of the combined switch 20 and display 21, together with the drivers 22, can be quite simple. In order that each LED provides a very distinct contribution to the overall pattern being created by illumination, each LED should be shielded from the others (such as with egg crate matrices shown in FIG. 4). These matrices are made out of metal, then the surfaces thereof can comprise a touch pad or a motionless touch button switch of the kind described in U.S. Pat. No. 5,036,321. Or as described in a somewhat different fashion in commonly owned, co-pending U.S. patent application of Screven et al entitled "Convertible Hybrid Touch Button Switch", Ser. No. 07/997,052 filed on Dec. 28, 1992, the aforementioned LEDs, egg crates and a frame surrounding them (as seen in FIG. 4) can be used as a touch pad which when pressed will actuate a microdot or other tactile switch (such as switch 56 in FIG. 4). The structure may also take the general form of that utilized in liquid crystal display switches produced by Cherry Electrical Products, Waukegan, Ill.

The embodiment described with respect to FIGS. 2 and 3, as it may be applicable to a single elevator system, eliminates the need for the set of position indicators 15 by means of a combination switch/display of the invention in place of the hall call button 13. It also can provide floor position display to other floors, at low cost if desired; for intermediate floors, two sets of the apparatus 20–22, 26, 27, 36–38, 40 and 45 would be used.

Elevator systems in which a particular landing is served by a plurality of elevators cannot have the floor position of all of the elevators in a single call button (as is the case in FIGS. 2 and 3). Instead, the purpose of the present invention is somewhat different. For instance, assuming there are several elevators serving a lobby floor. As described hereinbefore, passengers may request service by pressing a hall call button, and then wait until it becomes known which elevator is going to respond to the call. The indication of the particular elevator is typically given by a chime and lighting a hall lantern related to the assigned elevator, just as the elevator arrives at the floor. By means of the present invention, the hall call buttons may have displays therein such as elevator position displays of the type illustrated for the 23rd floor in FIG. 4. In FIG. 4, a combination switch/display 53 in accordance with the present invention includes a pair of display matrices 54, 55 as well as a switch 56. A switch amplifier 57 is shown connected to the switch 56 by a line 58; however, the switch amplifier 57 is normally disposed on the switch assembly, on a small circuit board. As is known, the switch amplifier 57 in a multi-elevator system is connected to a group controller 60 by a line 61, representing the communication system which normally operates between the hall call buttons and the group controller, not shown. The group controller 60 may take any one of a number of well-known forms, such as the early form of computerized group controller disclosed in U.S. Pat. No. 4,363,381, which may be deemed to be the basis of the embodiment herein, and which is incorporated herein by reference. The group controller 60, in turn, provides a plurality of signals on a trunk of lines 62 to a decode circuit 63 (similar to the decode circuit 27 of FIG. 2) for operating drivers 64, 65 similar to the drivers 22 of FIG. 2. The difference in the embodiment of FIG. 4 is that the group controller will provide the floor position (or other information) to the decode circuit 63, along with a signal indicating the registration of a car call. In a multi-elevator system, the floor position of only one elevator can be displayed on the hall call button. The elevator whose position is displayed is the elevator that is committed to respond to the call (in contrast with the temporary, repetitive assignments and reassignments which may occur in the relative system response operation of the aforementioned '381 patent). Thus, if a call were made from the 20th floor, and an elevator committed to answering that call were approaching it from above, the displays 54, 55 would begin showing floor numbers as soon as the car was committed to the call, eventually showing 23, 22, 21 and 20. In the case of an intermediate floor landing, such as the 20th floor, there would of course be at least two hall call switch display devices of the type illustrated in FIG. 4: one for up calls and one for down calls; for the highest and lowest floors, only one switch display device is needed. If desired, the one for up calls could have green LEDs and the one for down calls could have red LEDs, to further enhance information content to the passengers, although that is not necessary.

A routine which may be employed within the group controller 60 to provide the signals on the line 62 for correct operation of the displays 54, 55 may include the functions of the timer 40 in FIG. 3 within the software, or that apparatus may be included within the hardware associated with each push button/display 53. As is well known, in a multi-elevator system having a group control, each elevator has a hall lantern on each floor that it serves. On the intermediate floors, there are two hall lanterns, one to indicate that the related elevator is about to make a stop while traveling in the up direction, and the other to indicate that the elevator is about to make a stop while traveling in the down direction. In accordance with the invention, the indication of the floor position of whichever elevator it is that is assigned to answer the call can only be made after the call is committed to a particular elevator, which is therefore normally the same time that the hall lantern could be operated if desired. In the United States, the hall lanterns typically are not operated to indicate the approach of the elevator until the elevator is slowing for that particular floor. On the other hand, in some other countries, the hall lantern is operated as soon as it is known which elevator will answer the call. For the purposes of the present invention, it is immaterial which of these conventions are utilized; however, in the case of operation of the hall lanterns as soon as a car is committed to the call, the present invention has enhanced value since it informs the passengers continuously how close the elevator is to responding. As used herein "matrix" includes a pair of matrices as in FIG. 4.

Referring to FIG. 5, a floor position display routine, which may be performed in the group controller 60, is reached through an entry point 69 and a first step 70 sets N, a counter keeping track of floor number, to one (or the lowest floor). Then, a subroutine 71 relating to up calls display is performed. A test 72 determines if there is an up hall call for floor N; if there is not, a negative result of test 72 reaches a step 73 which sets a flag indicating that the up display for floor N should have none of the LEDs in the matrix illuminated. Then, a step 74 increments the N counter and a test 75 determines if all the floors have been processed or not. Initially, they will not have been, and a negative result of test 75 returns to test 72 to see if there is an up hall call on the second floor. Assuming that there is, an affirmative result of test 72 will reach a test 76 to determine if any elevator car has been committed to answer the hall call or not; such a car, when assigned in a committed way, is designated KAR. In some elevator systems, the commitment might not occur until the committable floor has been reached for a car which is assigned to the call; in such a case, the test 76 can be omitted and combined with the next test to be described. If the number of the car assigned to the call is zero, this means that no car has been assigned to the call; in such a case an affirmative result of the test 76 will reach a step 77 where a flag is set to cause the up display for the nth floor to illuminate all of the LEDs in the matrix. This provides the passenger with the normal illuminated touch pad as an indication that the call has been sensed and registered and will be responded to. In that sense, this is the same as the solid illumination described with respect to FIGS. 2 and 3 hereinbefore. On the other hand, if a car has been assigned to the call, then the result of test 76 will be negative reaching a test 79 which determines if the assigned car committable floor is the floor of the call under consideration. If the assigned car has not yet reached the committable position for the floor in question, a negative result of test 79 will reach a step 80 which sets a flag indicating that the up display on the nth floor should display the position of that car which has been assigned the up call at floor N. This is the manner in which the group controller 60 in FIG. 4 will determine a floor position to be displayed on the displays 54, 55. Then, the step 74 will increment the N counter and the test 75 will determine if all the floors have been examined or not.

In a subsequent pass through the subroutine 71 of FIG. 5, the car assigned to the up call at floor N will reach the committable position for that floor so the result of test 79 will be affirmative reaching the step 73, once again, causing nothing to be displayed. This is similar to the fact that the illumination of the car call button is normally turned off as soon as the floor lantern is energized, which typically is when the car reaches the committable position for the floor. Thus, the car call button/display 53 of FIG. 4 will normally be blank with no illumination when there is no outstanding call. As soon as a call is registered, the display will be complete with all of the LEDs of both displays 54, 55 illuminated, giving the passenger the normal call registration response. Once a car is committed to respond to the call, the displays 54, 55 will display the floor number of that car until the car reaches the committable position for that floor. At that time, typically as the hall lantern is turned on and the chime sounded, the display will again go dark just as it does in a normal case. Once all of the floors have been examined for up calls and position of assigned cars, and the display conditions are set correspondingly, the result of test 75 will be affirmative reaching a subroutine 81 in which the N counter is successively decremented as the down hall calls on successive floors are examined along with the committable floor positions of assigned cars, and the display conditions are set in the same fashion for down hall calls as is accomplished for up hall calls in the subroutine 71.

Figure 6:
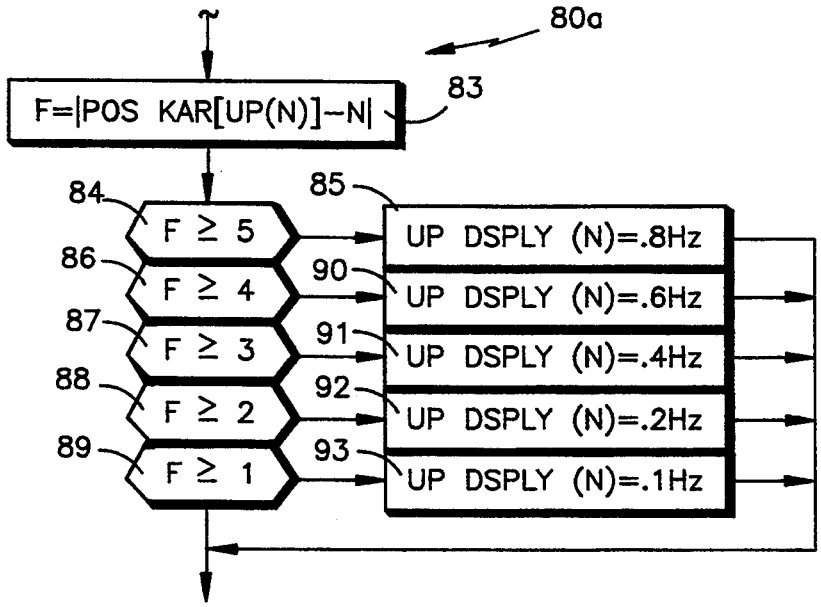
FIG. 6 is a logic flow diagram of a routine which may be used in a typical elevator system to operate the embodiment of FIG. 3 utilizing a varying flashing indication.

Instead of displaying floor number, it is possible to simply provide a flashing display, the speed of which is an indication of how far away the assigned elevator is from the floor of the call. An embodiment in which, once a car is committed to answer the call, flashing begins slowly and progresses in frequency as the car approaches the landing, is illustrated for up calls in FIG. 6. Therein, a subroutine 80*a* is substituted for the step 80 in FIG. 5. Instead of simply displaying the floor position of the assigned car, the subroutine 80*a* will cause flashing to occur as a function of how far away from the call the car is. In FIG. 6, a first step 83 provides the absolute value of the number of floors between the call and the current position of the assigned car. Then a test 84 determines if the car is five or more floors away. If it is, a step 85 will cause the display to be set to flash at the rate of 8 hertz. The flashing can either be a short momentary flashing of the kind described with respect to FIGS. 2 and 3 hereinbefore, or it could be any other duty cycle, the details of which can be implemented to suit any desired use of the invention. As the car approaches the floor of the call, the absolute value becomes less and less so that a plurality of tests 86–89 will progressively reach corresponding steps 90–93 to increase the frequency of flashing of the display. Or, the rate could increase instead of decrease. A similar subroutine can be provided for down hall calls. Similarly, the flashing can commence with a short-on/long-off duty cycle and advance to a long-on/short-off duty cycle as the car approaches, or vice versa. Or, frequency and duty cycle variations can both be used.

An alternative embodiment which provides an indication of how many floors away (from the floor at which service is requested) the elevator currently is, is by a trivial modification to the embodiment of FIG. 6 in which each of the steps 85, 90–93 will cause the display to display the same number as is in the related one of the tests 84 and 86–89. Thus, the display would progressively display five, four, three, two and one as the elevator progressed from being more than five floors away to being one floor away.

In the case of a lobby corridor served by a high rise elevator which has an express zone within which it travels at high speed without any stops, such as between the lobby and the 10th or 15th floor, an alternative display may be utilized. One possible display is simply to recognize any time that a car is traveling downward in the express zone and to provide a flashing display (whether or not the hall call button would have previously been in the steady on condition because someone has pressed the hall call switch or the display was off because no one has pressed the hall call switch). The reason is that cars are traveling downward at the highest permissible speed which is sufficiently fast that any information changes too quickly to be easily assimilated or of much value. The best notion, therefore, might be simply to provide flashing so as to warn passengers of the impending approach of a car to the lobby.

Figure 7:
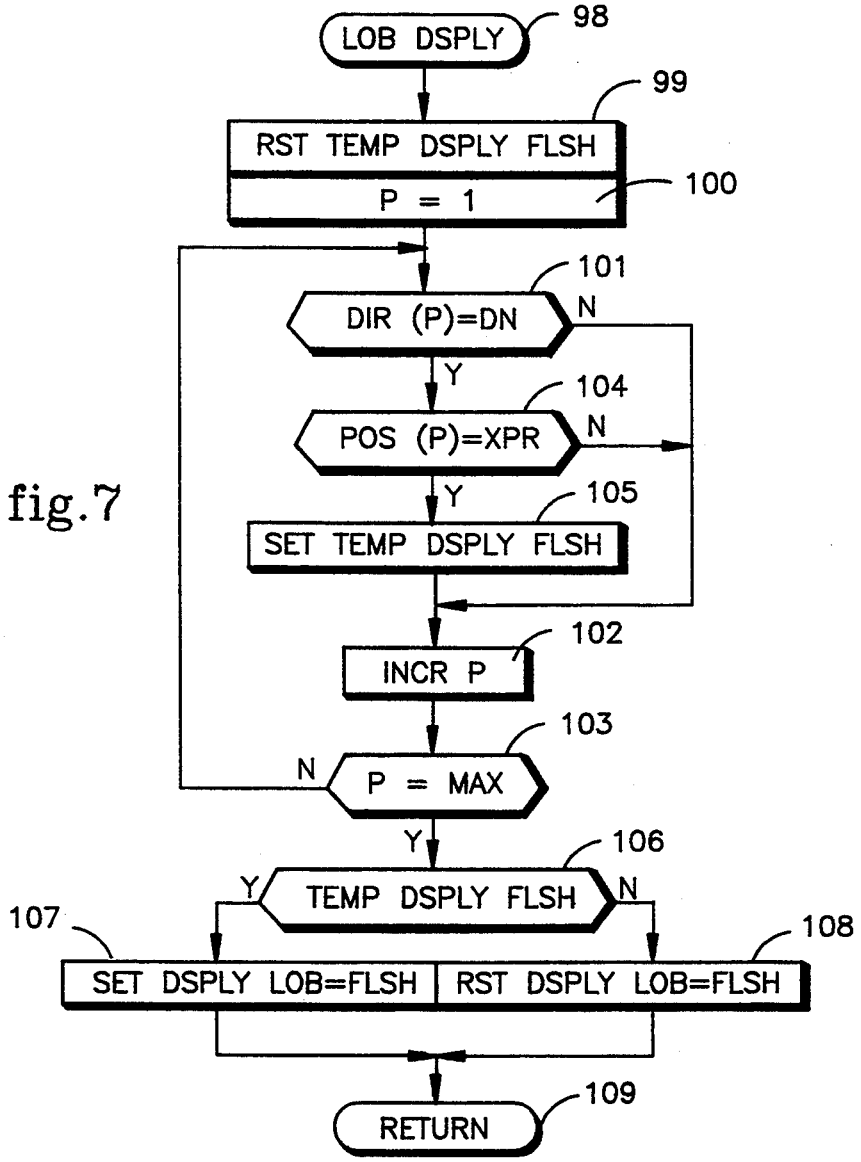
FIG. 7 is a logic flow diagram of a routine which may be used in a typical elevator system to operate the embodiment of FIG. 3 utilizing a flashing signal to announce the approach of a high rise elevator to a lobby through an express zone.

In FIG. 7, a lobby display subroutine is reached through an entry point 98 and a first step 99 resets a temporary display flashing flag. Then, a counter P (which counts elevator cars) is initialized at one, in a step 100. A test 101 determines if the call direction for the first car (car 1 or the lowest numbered car) is in the down direction. If not, a step 102 increments the P counter and a test 103 determines if this is the highest numbered car or not. Initially, it will not be, so a negative result of test 103 will return the routine to test 101 to determine if the direction of the next car is down or not. If it is, an affirmative result of the test 101 will reach a test 104 to determine if the position of this car is within the express zone. If not, the step 102 is reached to increment P, and a test 103 determines if this is the last car. If not, test 101 is repeated. If any of the cars traveling in a down direction are within the express zone, affirmative results of test 101 and 104 will cause a step 105 to be reached where the temporary display flashing flag is set. Eventually, all of the cars will have been tested so an affirmative result of test 103 will reach a test 106 to determine if any of the cars have set the temporary display flashing flag. If so, then a flag to cause the lobby display to flash is set in a step 107. But if not, a step 108 resets that flag, and other parts of the computer programming are then reached through a return point 109. The indication that the lobby display should be flashing, set in step 107, can be utilized as a discrete signal to simply periodically reverse the illuminated or non-illuminated condition of all of the display. In turn, this may be accomplished by causing a flashing signal to be exclusive ORd with a car call response signal which would otherwise tend to illuminate the entire display in a steady state, as described with respect to FIGS. 2 and 3 hereinbefore. The embodiment of FIG. 7 announces, by flashing, any downwardly traveling elevator in an express zone. Another embodiment, shown in FIG. 8, may provide floor position to all of the floors except the lobby, as in step 80 (FIGS. 5 and 8) in response to a negative result of a test 110 (FIG. 8), and simply provide for flashing of the display by means of a step 111 whenever an affirmative result of test 110 indicates that it is a lobby call. Other variations in these themes can of course be implemented within the invention.

Figure 8:
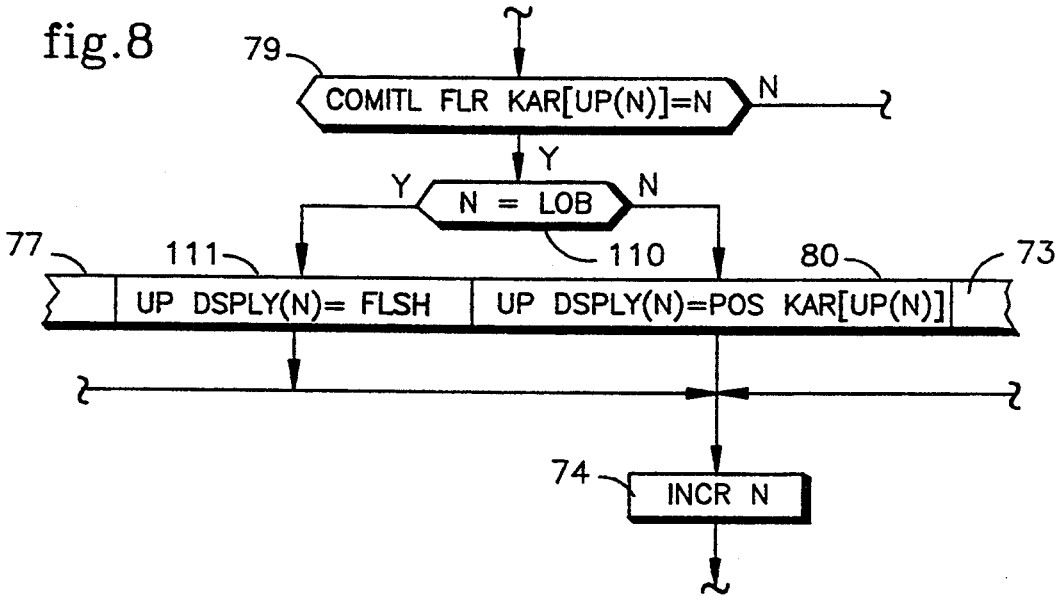
FIG. 8 is a modification to FIG. 5, for flashing the lobby display.

Of course, in the case of simply flashing the indication as at the lobby floor, which has been described with respect to FIGS. 7 and 8, the illumination need not be achieved by a matrix of LEDs, since the entire touch pad is either fully illuminated or not illuminated at all, in every case; thus, other forms of illumination of the touch pad could be employed for this limited purpose, in a system employing LED display touch buttons on the other floors. But, for uniformity of repair parts, it is most advantageous to use for all the display/buttons, dual displays of FIG. 4 in any building having 10 or more floors, or single matrix displays in buildings of less than 10 floors—which generally will not have an express zone anyway.

For lobby floors, whether they be for high rise elevators having an express zone immediately above the lobby or not, there is no need to have two displays 54, 55 since there would be no need to display any floors above the ninth floor, the information being provided from the ninth downwardly through the first floor being sufficient warning to passengers at the lobby. And in the case of an express zone above the lobby, either the same would be true, or simply flashing a single display 54 or 55 would be sufficient, as is described with respect to FIGS. 7 and 8 hereinbefore. Only one switch display is needed on the highest and lowest floors, but two (up and down) are needed on intermediate floors.

Figure 9:
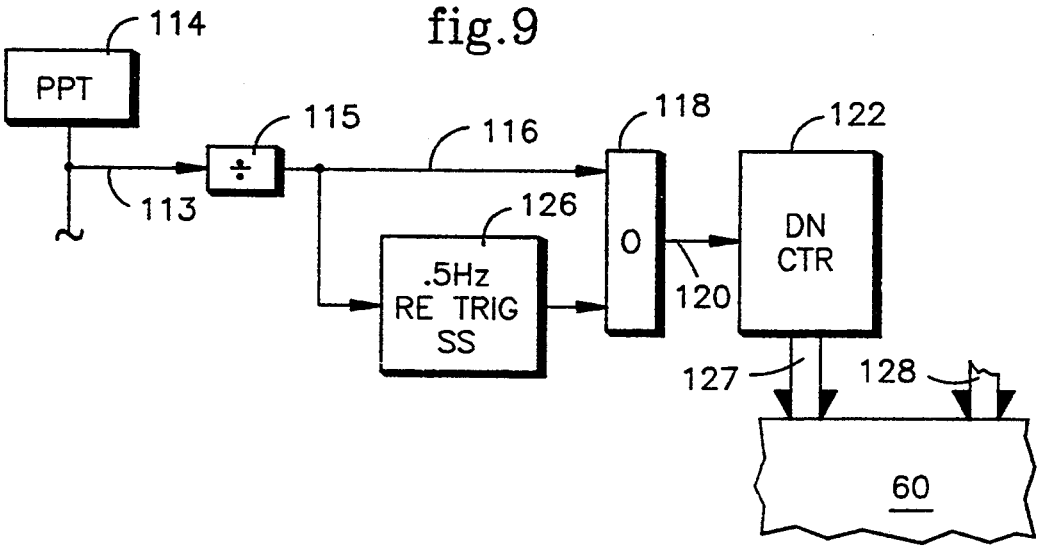
FIG. 9 is a schematic diagram of a circuit for generating a relative delay number to give an indication of impending arrival of an assigned elevator car.
Figure 10:
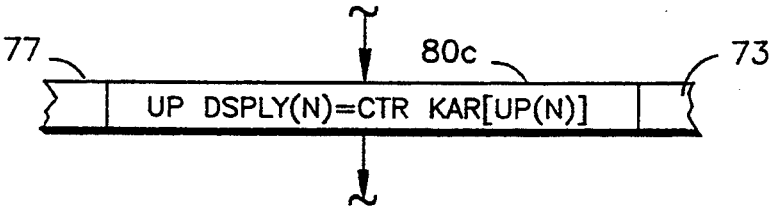
FIG. 10 is a modification of FIG. 5 to use the number of FIG. 8.
Figure 11:
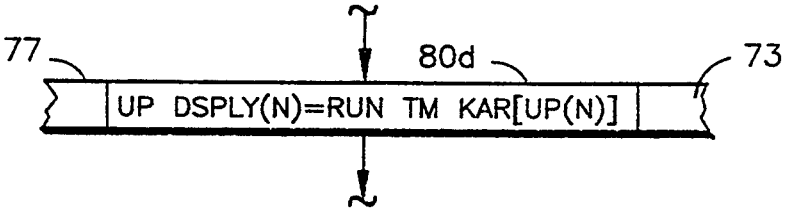
FIG. 11 is a modification of FIG. 5 to use remaining run time to the call.

Referring to FIG. 9, another embodiment of the present invention may simply provide the down count of some arbitrary number, which begins to be displayed when a car is committed to the call, and decreases in number until the car is at the committable position for the floor where the call is registered. In a particular embodiment, the count down is achieved at a speed which is related to the speed of the elevator, except when the elevator is at a floor stop, in which case the count down continues at a very slow pace such as lowering the count once for every one or two seconds. To achieve that, a signal may be derived on a line 113 from a position transducer 114, such as the primary position transducer in the aforementioned '381 patent. This signal would typically be taken from one of the timing tracks and provided to a divide circuit 115, which typically may comprise a suitable counter, the terminal count of which would provide a signal on a line 116 passed through an OR circuit 118 to provide a clocking signal on a line 120 to advance a down counter 122. The characteristics of the divider 115 can be chosen to provide the desired rate of change of down count such as twice per second at the highest speed, or otherwise as desired for any implementation of the invention. The down counter may typically start with a count of on the order of 30 or 50 at the time that a car is committed to the floor and this number may be chosen in dependence upon the typical length of time between commitment and answering of the call, in dependence upon the system in which the invention is used. In the embodiment of FIG. 9, whenever the elevator makes a stop, the counter 122 can continue to be clocked at a very slow rate by some other means, such as a half hertz retriggerable single shot 126. This device is such that so long as it continues to receive input signals on the line 116, there is no output, but after two seconds go by with no signal on the line 116, the single shot issues a pulse to the OR circuit 118, and this continues every two seconds until input signals are applied on the line 116. In this way, some minimally slow advancement of the down counter 122 will occur even when the elevator is at a floor stop ahead of the call. The output of the down counter 122 is provided on a plurality of lines 127 to the group controller 60, along with signals on other lines, such as lines 128, from down counters associated with each of the elevator cars in the group. FIG. 10 illustrates a modification to FIG. 5 wherein the step 80 is substituted for step **80*c* in which the up display for floor N is set to be the counter output for the car committed to the up call at floor N. Of course, the frequency can be changed to suit any implementation of the present invention; other methods can be devised to provide a relative down count display in accordance with the invention. All of this may of course be achieved instead by software. In FIG. 11, a step 80*d* may be used in FIG. 5 to display the remaining run time to the call. This may include door time (FIG. 9) and run time (FIG. 10**, without contiguous preference) in said '381 patent, or otherwise, or more modern calculations thereof available in the art.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. An elevator hall call touch button switch display disposed in a multi car elevator group serving a plurality of floors in a building, comprising:

a single elevator hall call touch button switch disposed on each of said floors, each having a touch pad comprising a plurality of LEDs disposed in a matrix so that illumination thereof portrays information visually to a passenger;

means associated with an elevator car selected to respond to a request for service initiated by operation of one of said switches to provide signals indicative of the proximity of said selected elevator car to the floor of said one switch; and circuitry responsive to said signals for illuminating said LEDs to provide a visual indication of said signals to passengers.

2. A switch display according to claim 1 wherein said signals cause said LEDs to display the floor number of the floor position of said selected elevator car.

3. A switch display according to claim 1 wherein said signals are indicative of the floor position of said selected elevator car.

4. A switch display according to claim 3 wherein said signals are indicative of the numerical difference between the floor position of said selected elevator car and said floor of said one switch.

5. A switch display according to claim 4 wherein said signals cause said LEDs to provide a flashing indication, the frequency of which varies with the floor position of said selected elevator car.

6. A switch display according to claim 5 wherein said frequency becomes lower as said selected elevator car approaches said floor of said one switch.

7. A switch display according to claim 4 wherein said signals cause said LEDs to provide a flashing indication, the duty cycle of which varies with the floor position of said selected car.

8. A switch display according to claim 4 wherein said signals cause said LEDs of said one switch to display the numerical difference between said floor position of said selected elevator car and said floor of said one switch.

9. An elevator hall call touch button switch display, comprising:

an elevator hall call touch button switch having a touch pad comprising a plurality of distinct LEDs disposed in a matrix so that selective illumination thereof portrays information visually to a passenger;

means associated with an elevator car which is committed to answer a request for service initiated by operation of said hall call touch button switch to provide signals indicative of the proximity of the elevator car which is to respond to said request for service;

circuitry responsive to said signals for illuminating selected ones of said LEDs to provide a visual indication of said signals to passengers; and means for providing signals to illuminate substantially all of said LEDs for a limited time following operation of said hall call touch button switch to register a request for service.

10. An elevator hall call touch button switch display associated with an elevator car, comprising:

an elevator hall call touch button switch having a touch pad comprising a plurality of distinct LEDs disposed in a matrix so that selective illumination thereof portrays visual information to a passenger;

means for providing signals indicative of the floor position of an elevator car associated with said switch;

means for providing signals to illuminate substantially all of said LEDs for a limited time following operation of said hall call touch button switch to register a request for service; and circuitry for illuminating said selected ones of said LEDs to provide a visual indication of said floor position and for illuminating all of said LEDs during said limited time.

11. A switch display according to claim 10 wherein said LEDs display floor position of said elevator car at all operative times except during said limited time.

12. A switch display according to claim 10 wherein said LEDs display floor position of said elevator car at all operative times except during said limited time and short intervals of time following said limited time until said elevator reaches the committable position of the floor where said switch and display is disposed.

13. An elevator hall call touch button display, comprising:

an elevator hall call touch button switch having a touch pad comprising a plurality of distinct LEDs disposed in a matrix, the selective illumination of which portrays visual information to waiting passengers, said touch button switch disposed at a floor of a building to register calls for service to said floor;

means, associated with an elevator car which is committed to stop at said floor in response to a call registered by operation of said touch button switch, to provide display signals indicative of the approach of said elevator to said floor; and circuitry responsive to said display signals for illuminating said LEDs to provide a flashing visual indication of said signals to passengers.

14. An elevator hall call touch button switch display according to claim 13 wherein said display signals cause said flashing indication at a frequency which varies with the floor position of said elevator.

15. An elevator hall call touch button switch display, comprising:

an elevator hall call touch button switch having a touch pad comprising a plurality of distinct LEDs disposed in a matrix, the selective illumination of which portrays visual information to waiting passengers, said touch button switch disposed at a floor of a building to register calls for service to said floor;

means associated with an elevator car which is committed to stop at said floor to provide display signals indicative of the approach of said elevator to said floor;

circuitry responsive to said display signals for illuminating said LEDs to provide a visual indication of said signals to passengers;

means for providing signals to illuminate substantially all of said LEDs for a limited time following operation of said hall call touch button switch to register a request for service; and wherein said display signals provide a variation in said display after said limited time.

16. An elevator hall call touch button display disposed to register calls at a lobby floor of a building having an express zone immediately above the lobby floor, comprising:

a plurality of elevators, each including means for providing position signals indicative of its instantaneous floor position and direction signals indicative of its travel direction being up or down;

an elevator hall call touch button switch having a touch pad comprising a plurality of distinct LEDs disposed in a matrix, the selective illumination of which portrays visual information to waiting passengers, said touch button switch disposed at said lobby floor of said building to register calls for service to said lobby floor;

a group controller responsive to said direction and position signals of each of said elevators for providing a lobby signal indicative of any one of said elevators having a down travel direction and a floor position within said express zone, and for providing display signals indicative of the approach of said one elevator to said lobby floor in response to said lobby signal; and circuitry responsive to said display signals for illuminating said LEDs to provide a visual indication of said display signals to passengers.

17. An elevator hall call touch button switch display in a building having a high rise elevator group with an express zone immediately above a lobby floor, comprising:

an elevator hall call touch button switch having a touch pad comprising a plurality of LEDs, the illumination of which portrays visual information to a passenger, said touch button switch disposed to register calls for service to said lobby floor;

a plurality of elevators, each including means for providing position signals indicative of its instantaneous floor position and direction signals indicative of its travel direction being up or down; and a group controller responsive to said direction and position signals of each of said elevators for providing a lobby signal indicative of any of said elevators having a down travel direction and a floor position within said express zone, for registering calls requested by operation of said touch button switch, for illuminating said LEDs in response to registering one of said calls, and for causing said LEDs to flash on and off in response to said lobby signal, regardless of the registering of one of said calls.

* * * * *